US006739258B2

(12) United States Patent
König et al.

(10) Patent No.: US 6,739,258 B2
(45) Date of Patent: May 25, 2004

(54) PRINTING MACHINE PROVIDED WITH A CLEANING DEVICE

(75) Inventors: Werner König, Mannheim (DE); Rolf Kündgen, Eppelheim (DE); Gerd Merkel, Dielheim (DE); Bernd Sitzmann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/790,937

(22) Filed: Feb. 22, 2001

(65) Prior Publication Data

US 2001/0050015 A1 Dec. 13, 2001

(30) Foreign Application Priority Data

Feb. 22, 2000 (DE) ..... 100 07 997

(51) Int. Cl.[7] ..... B41F 35/00
(52) U.S. Cl. ..... 101/425; 101/423
(58) Field of Search ..... 101/425, 423, 101/424; 15/256.51, 256.52; 134/153, 165, 137

(56) References Cited

U.S. PATENT DOCUMENTS

| | | | | |
|---|---|---|---|---|
| 2,302,490 A | | 11/1942 | Curtis | 101/423 |
| 3,987,511 A | * | 10/1976 | Mayer et al. | 15/21 D |
| 4,344,362 A | | 8/1982 | Ishii | 101/425 |
| 5,507,229 A | * | 4/1996 | Rogge et al. | 101/424.1 |
| 5,543,903 A | * | 8/1996 | Fujita et al. | 355/283 |
| 5,622,112 A | | 4/1997 | Kusch et al. | 101/423 |
| 5,894,800 A | * | 4/1999 | Bar et al. | 101/425 |

FOREIGN PATENT DOCUMENTS

| | | |
|---|---|---|
| DE | 31 00 238 C2 | 12/1981 |
| DE | 43 28 834 A1 | 3/1995 |
| DE | 44 22 612 C1 | 6/1995 |

* cited by examiner

*Primary Examiner*—Anthony H. Nguyen
(74) *Attorney, Agent, or Firm*—Laurence A. Greenberg; Werner H. Stemer; Gregory L. Mayback

(57) ABSTRACT

A printing machine provided with a rectilinear guide and a cleaning device having a handle for moving the cleaning device along the rectilinear guide includes at least one joint by which the handle is attached to the cleaning device in a manner that the handle is movable relative to the cleaning device.

12 Claims, 6 Drawing Sheets

PRINTING MACHINE PROVIDED WITH A CLEANING DEVICE

BACKGROUND OF THE INVENTION

Field of the Invention

The invention relates to a printing machine provided with a cleaning device, the printing machine having a rectilinear guide and a handle for moving the cleaning device along the rectilinear guide.

The published German Patent Document DE-3 100 238 C2 discloses such a printing machine. The cleaning device thereof is equipped with a handle (note FIG. 2, item 19 of the German patent document), which is too short, however, for convenient movement of the cleaning device in the printing machine.

Japanese Patent 2 578 123 discloses another printing machine corresponding to the general type described in the introduction hereto. The cleaning device thereof has a handle (note FIG. 7, item 24 of the Japanese patent) of such length as to admittedly make it more suitable for conveniently moving the cleaning device within the printing machine but which, because of the rigid connection thereof to the cleaning device, makes the latter difficult to operate outside the printing machine. The cleaning device and the handle, when combined, are too long and too bulky.

SUMMARY OF THE INVENTION

Based upon the aforementioned prior art, it is therefore an object of the invention to provide a printing machine of the general type cited in the introduction hereto which has a cleaning device user-friendly both within the printing machine and outside the printing machine.

With the foregoing and other objects in view, there is provided, in accordance with the invention, a printing machine provided with a rectilinear guide and a cleaning device having a handle for moving the cleaning device along the rectilinear guide, comprising at least one joint by which the handle is attached to the cleaning device in a manner that the handle is movable relative to the cleaning device.

In accordance with another feature of the invention, the handle is disposed on a rod which is mounted in the joint.

In accordance with a further feature of the invention, the joint is a pivot.

In accordance with an added feature of the invention, the joint is a sliding joint.

In accordance with an additional feature of the invention, the handle is arranged as an operating element of at least one securing device.

In accordance with yet another feature of the invention, the securing device is constructed for securing the handle in a predetermined position wherein the handle is adjustable relative to the cleaning device.

In accordance with yet a further feature of the invention, the securing device is constructed for securing the cleaning device in a predetermined position wherein the cleaning device is adjustable relative to the printing machine.

In accordance with yet an added feature of the invention, the handle is arranged as an operating element of at least one setting device.

In accordance with yet an additional feature of the invention, the setting device is constructed for switching an electrical switching device.

In accordance with a concomitant feature of the invention, the setting device is constructed so as to displace at least one monitoring device.

Thus, the printing machine according to the invention, which includes a rectilinear guide and a cleaning device having a handle for moving the cleaning device along the rectilinear guide. The handle is connected to the cleaning device via at least one joint for moving the handle relative to the cleaning device.

An advantage of the printing machine according to the invention resides in the fact that the handle, guided by the joint, can be optionally adjusted either to a longer distance or to a shorter distance from the cleaning device. In order to insert the cleaning device into the printing machine through an aperture in the latter and to withdraw it from the printing machine, the handle can be set to the long distance from the cleaning device. In order to carry the cleaning device by the handle through a print room wherein the printing machine is located, the handle can be set to the short distance so that the cleaning device and the handle combined are very compact.

In an embodiment which is advantageous in terms of the arrangement of the handle on a long rod, the joint is constructed as a slide joint. It is thus possible to insert the rod along a sliding axis of the slide joint into the cleaning device and withdraw it from the cleaning device in order to move the handle towards and away from the cleaning device.

In a further embodiment which is advantageous in terms of multifunctional use of the handle, the joint is constructed as a pivot. By rotating the handle about an axis of rotation of the pivot, a securing device can be secured or disengaged from the securing condition thereof, or a setting device can be adjusted. The handle can thus include a further function, in addition to that of moving the cleaning device, in that the handle forms an operating element for actuating at least one device.

Preferably, for moving the handle relative to the cleaning device, the handle is attached to the cleaning device both via the pivot and via the sliding joint. It is, however, also possible to combine the functions of the pivot and the sliding joint in a single rotating and sliding joint.

Other features which are considered as characteristic for the invention are set forth in the appended claims.

Although the invention is illustrated and described herein as embodied in a printing machine provided with a cleaning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
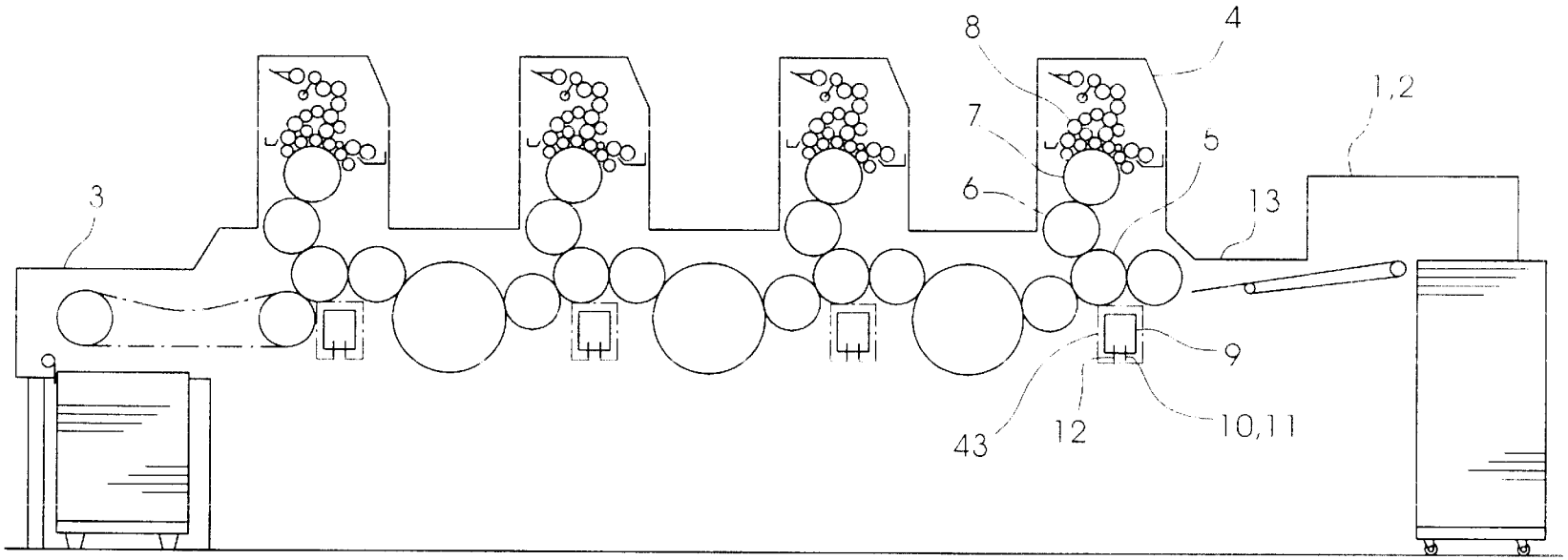
FIG. 1 is a diagrammatic side elevational view of a printing machine having a cylinder and a cleaning device which is used for cleaning the cylinder in the printing machine.

Referring now to the drawings and, first, particularly to FIG. 1 thereof, there is shown therein a rotary printing machine 1 having a sheet feeder 2, a sheet delivery 3 and at least one offset printing unit 4 which includes an impression cylinder 5, a blanket cylinder 6, a printing form cylinder 7 and, for inking thereof, an inking unit 8. To clean the cylinder 5, a beam-shaped cleaning device 9 is arranged adjacent thereto and is slidable into the printing machine 1 on a rectilinear guide or slide bar 10 disposed axially parallel to the cylinder 5, and withdrawable from the printing machine 1. The rectilinear or crosshead guide 10 is formed of two rails 11 and 12 extending perpendicularly to the conveying direction of the printing material and horizontally, and being fixed on a frame 13 of the printing machine 1.

Figure 2:
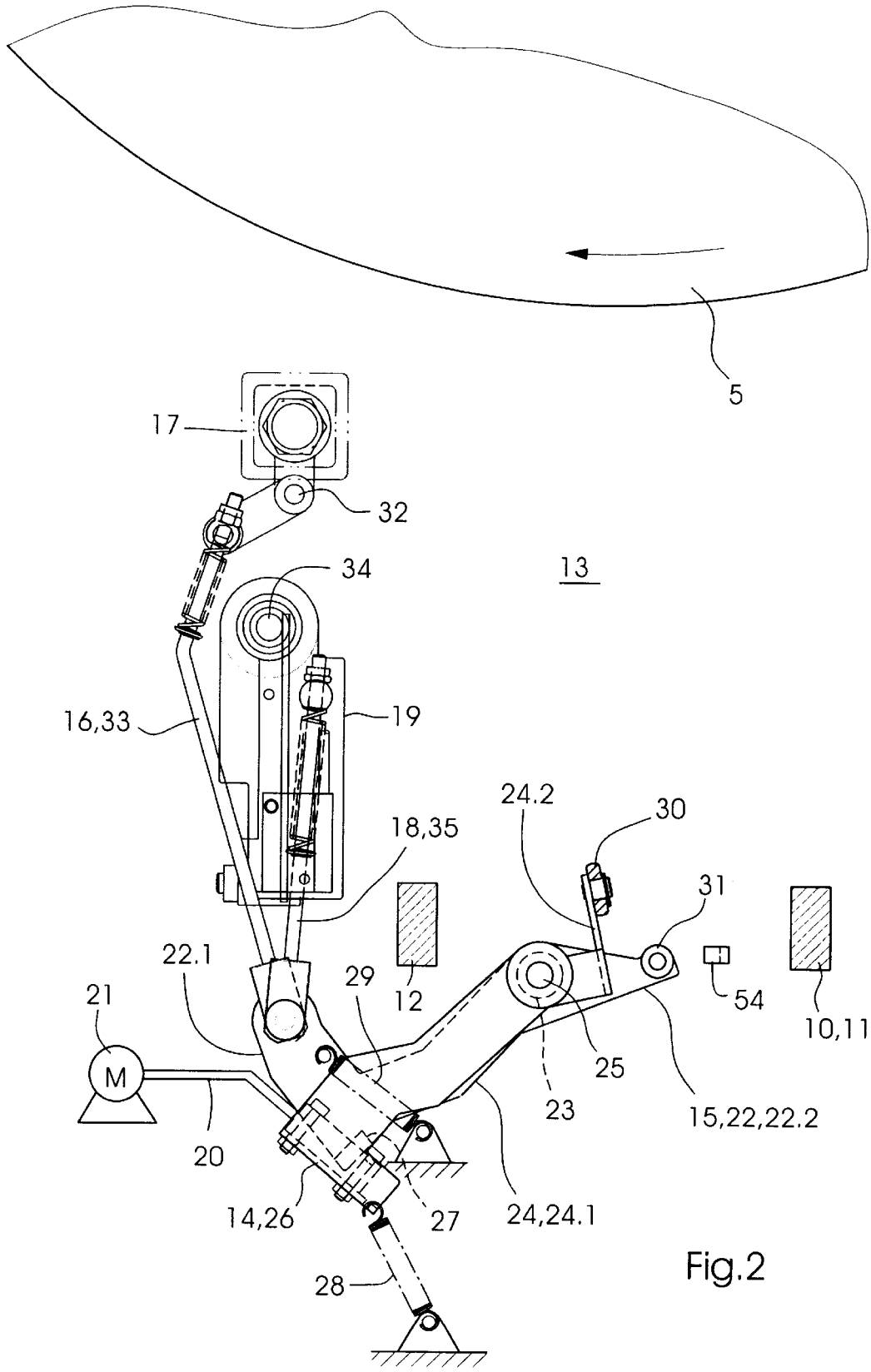
FIG. 2 is an enlarged fragmentary front elevational view, partly diagrammatic and in section, of the printing machine with the cleaning device removed therefrom.

FIG. 2 shows the guide 10 with the cleaning device 9 removed therefrom, and devices 14 to 19 of the printing machine 1 arranged adjacent to the guide 10.

An electrical switching device 14 is provided for opening and closing an electric circuit 20 which supplies current to an electric motor 21 serving as the main drive of the printing machine 1 for rotatively driving the cylinder 5.

A setting device 15 is adjustable for resetting the switching device 14. The setting device 15 is formed of a double-armed or bellcrank lever 22, which is pivotable about a pivot 23 rigid with the frame, and a double-armed or bellcrank lever 24, which is pivotable about a pivot 25 rigid with the frame and is arranged coaxially with the pivot 23 rigid with the frame. An electrical switch 26 of the switching device 14, located within the electric circuit 20, is arranged on one arm 24.1 of the lever 24, and a switching ramp 27 for actuating the switch 26, which occurs by pressing the switch 26, is arranged on an arm 22.1. A respective tension spring 28, 29 is articulated at one end thereof on each of the arms 22.1 and 24.1, the other ends of the tension springs 28 and 29 being articulated on the frame 13. Because the helical springs 28 and 29, respectively, engage with the levers 22 and 24, the devices 14 to 19 are held in the positions thereof shown in FIG. 2. A roller 30 and 31, respectively, is rotatably fixed on each of the arms 22.2 and 24.2, respectively, of the levers 22 and 24, so that the axes of rotation of the rollers 30 and 31 are oriented perpendicularly to one another.

Via a setting device 16, a monitoring device 17 serving to monitor the cleaning device 9 is movable from a passive position (note FIG. 2) into an active position (note FIG. 7) and back. Via a setting device 18, a further monitoring device 17 serving to monitor the cleaning device 9 is movable from a passive position (note FIG. 2) into an active position (note FIG. 7) and back. Each of the setting devices 16 and 18 is constructed as a four-link coupler mechanism having a swinging drive arm formed by the lever 22 and a swinging take-off arm formed by the respective monitoring device 17 or 19.

The monitoring device 17 is arranged to pivot about a pivot 32 of the coupler mechanism arranged stationarily on the frame 13. A coupler 33 of the setting device 16, formed as a spring rod, is articulated by one end, eccentrically relative to the joint 32, on the monitoring device 17 and articulated by the other end thereof on the arm 22.1 of the lever 22. The monitoring device 19 is likewise arranged to pivot about a pivot 34 arranged stationarily on the frame 13. A coupler 35 of the setting device 18, likewise constructed as a spring rod, is articulated by one end, offset eccentrically relative to the joint 34, on the monitoring device 19 and articulated by the other end thereof on the lever 22. By the setting devices 16 and 18, constructed as flat coupler mechanisms of the four-pivot chain, the monitoring devices 17 and 19 are movable simultaneously towards the cleaning device 9 and then simultaneously away from the cleaning device 9.

Figure 3:
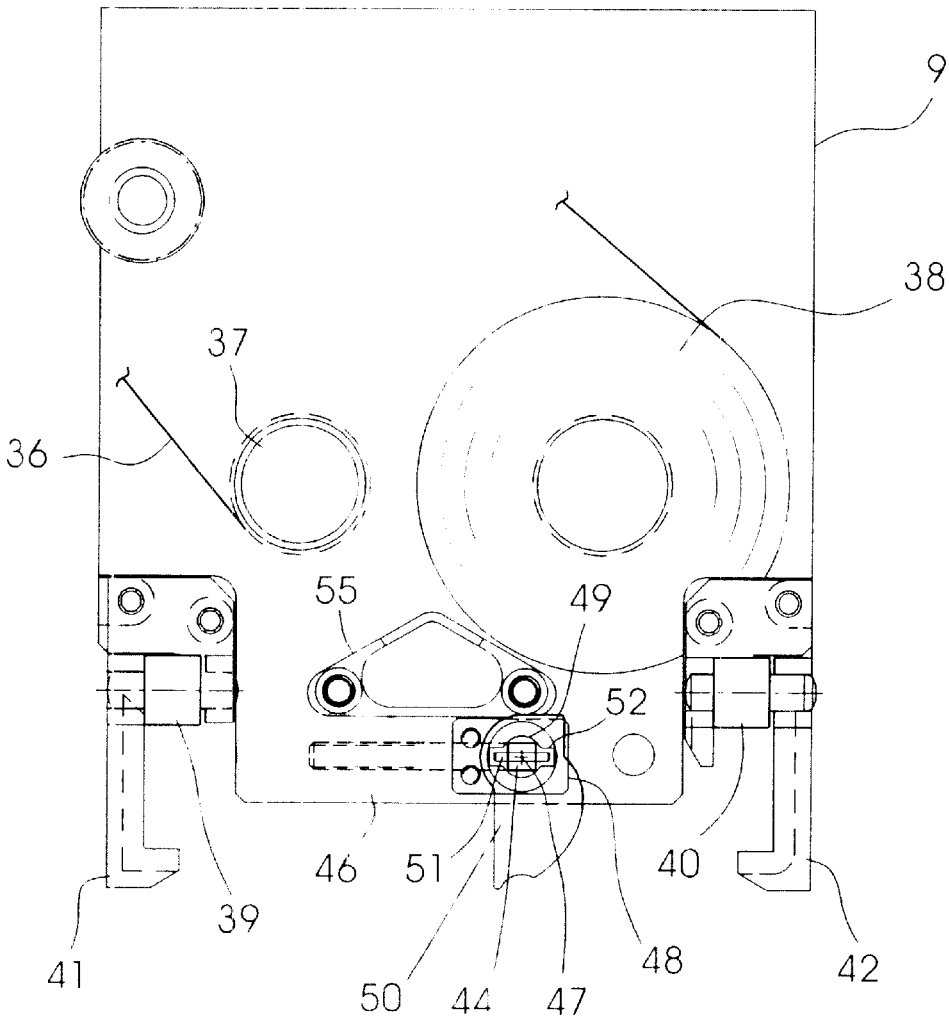
FIG. 3 is an enlarged front elevational view of the cleaning device which has been removed from the printing machine, and which includes a rod with a handle.

The monitoring device 17 serves for measuring the advance of a woven or nonwoven cleaning belt 36, while the latter is unwound from a roll 37 of clean cloth and wound up onto a roll 38 of soiled cloth of the cleaning device 9 (note FIG. 3).

The monitoring device 19 interrupts the unwinding of the belt 36 from the roll 37 as soon as the length of the section of the belt 36 still wound on the roll 37, and hence the number of the wound layers of the belt 36 on the roll 37, is so small that a danger exists that an end of the belt 36 fixed to the roll 37 would become detached on further unwinding from the roll 37. The belt 36, during the washing of the cylinder 5 by the cleaning device 9, is pressed against the circumferential surface of the cylinder 5.

In order for it to be possible for the cleaning device 9 to be inserted into the printing machine 1 through a window 43 (note FIG. 1) without colliding with the monitoring device 17, often also described as a cloth travel sensor, and without colliding with the monitoring device 19, often also described as a cloth end sensor, the monitoring devices 17 and 19 are adjusted by the setting devices 16 and 18 out of the insertion path of the cleaning device 9 into the passive position (note FIG. 2).

After the cleaning device 9 has been inserted into the operating position thereof for washing the cylinder 5 in the printing machine 1, a displacement, explained in detail hereinbelow, of the monitoring devices 17 and 19 towards the cleaning device 9 and onto the cleaning belt 36 takes place simultaneously with a locking of the cleaning device 9 in this operating position.

Figure 6:
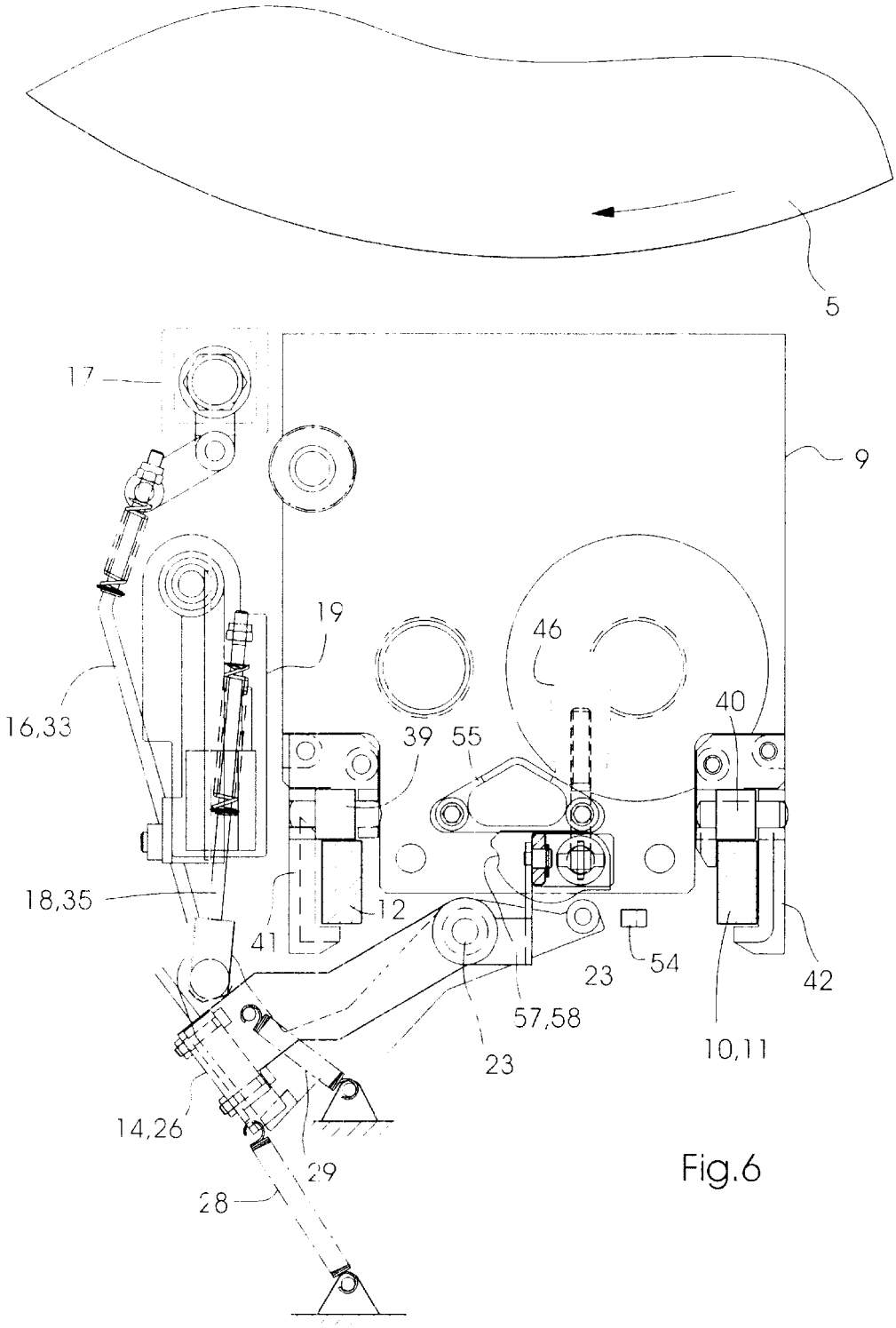
FIG. 6 is a view similar to that of FIG. 2 and showing the cleaning device, in a front elevational view, during the insertion thereof into the printing machine.
Figure 7:
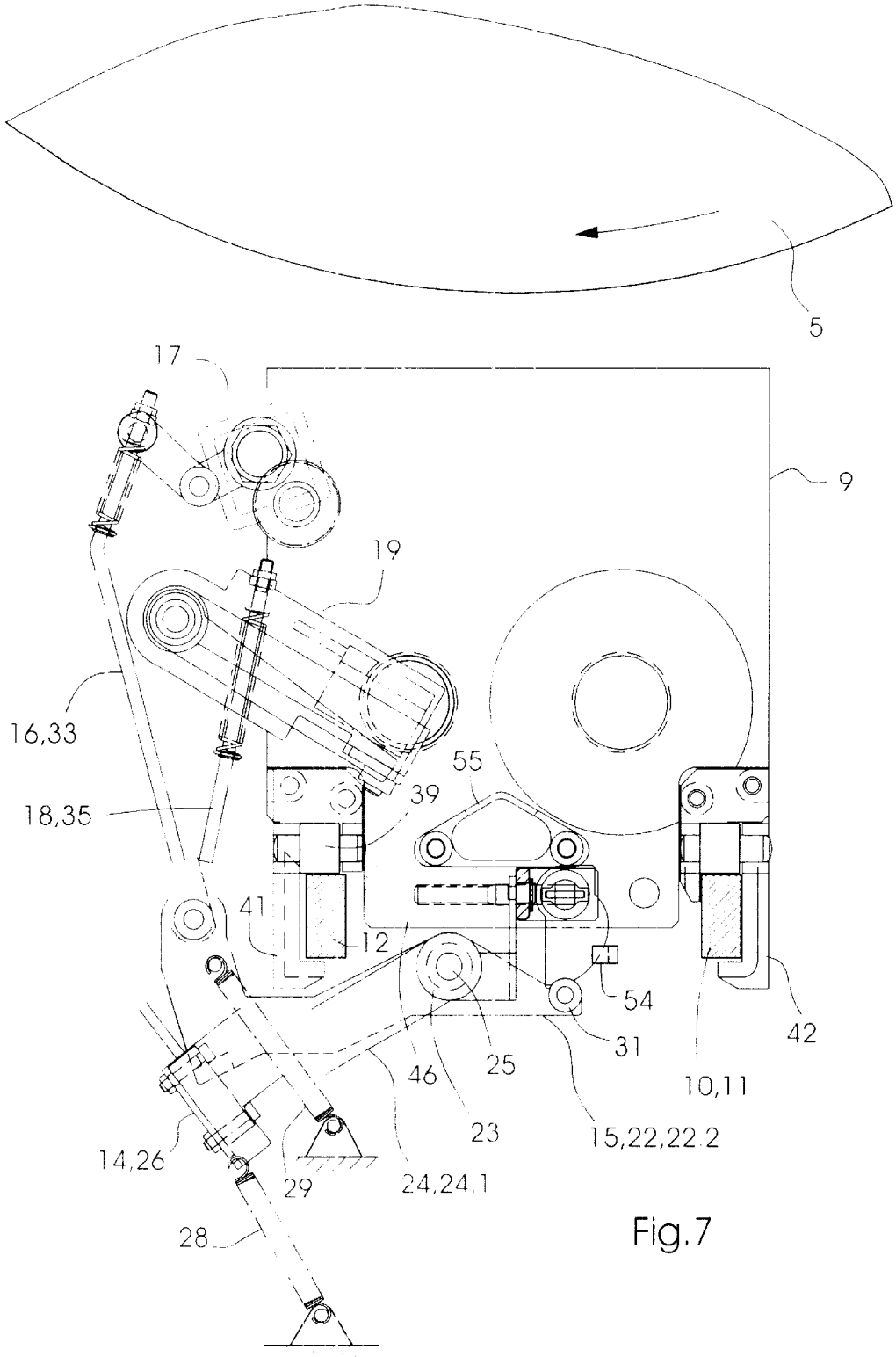
FIG. 7 is a view similar to that of FIG. 6, but in a different operating phase of the cleaning device, wherein the handle has been turned into a rotary position for locking the cleaning device to the printing machine.

As shown in FIGS. 6 and 7, the cleaning device 9 is equipped with rollers 39 and 40, which roll on top of the rails 11 and 12 when the cleaning device 9 is moved, and the cleaning device 9 has securing brackets 41 and 42 which rest on the outsides and undersides of the rails 11 and 12 and thus secure the position of the cleaning device 9 on the guide 10 in directions perpendicular to the insertion and guidance directions thereof. The guide 10 ends approximately flush with the window 43 and does not project out of the printing machine 1, so that there is no danger at all of injury caused by the guide 10.

Figure 4:
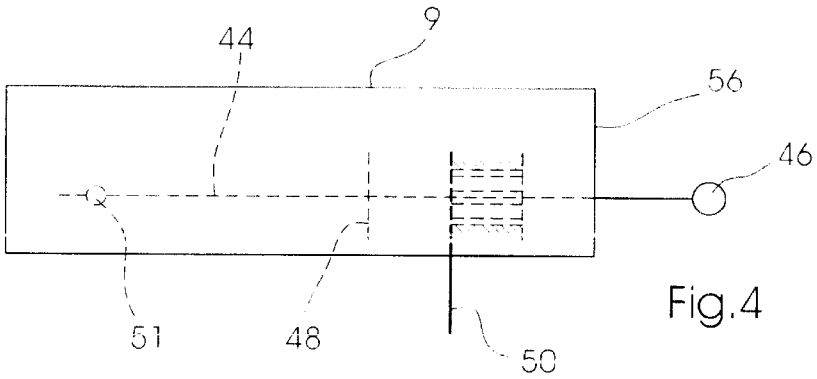
FIG. 4 is a diagrammatic side elevational view of the cleaning device into which the rod has been inserted, the cleaning device having been removed from the printing machine.

In FIG. 4, the cleaning device 9 is illustrated diagrammatically and shows that a rod 44 constructed so as to be of approximately the same length as that of the cleaning device 9 is mounted in joints 45 and 60 on the cleaning device 9. A handle 46 is disposed on a downward-angled end of the rod 44, by which the operator can turn the rod 44 relative to the cleaning device 9 about a rotational and sliding axis 47 (note FIG. 3) of the joints 45 and 60, the operator being able to slide the rod 44 into the cleaning device 9 and withdraw it from the cleaning device 9 along the axis 47.

With the rod 44 inserted into the cleaning device 9 (note FIG. 4), the cleaning device 9 can be manipulated easily outside the printing machine 1. The rod 44 withdrawn from the cleaning device 9 (note FIG. 5) increases the operator's reach, so that the cleaning device 9 can easily be moved into the operating position thereof within the printing machine 1 and withdrawn therefrom.

The joint 45 is formed as a pivot and includes a bushing 53, which is secured against displacement along the axis 47 and is mounted so as to be rotatable about the axis 47 in a hole formed in the cleaning device 9. A cam 50 is fixedly connected to the bushing 53, the cam 50 and the bushing 53 forming, for example, a single casting, and thus being turnable together with the bushing 53 about the axis 47. A recess of square and hence polygonal cross section, through which the rod 44 is thrust, extends through the cam 50 and the bushing 53 towards the axis 47. The cross section of the rod 44 thrust through the cam 50 and the bushing 53 is likewise square and hence polygonal in form, so that the rod 44 is seated in the recess with a positive or formlocking fit. In this regard, it is noted that a formlocking connection is one which connects two elements together due to the shape of the elements themselves, as opposed to a forcelocking connection, which locks the elements together by force external to the elements. Because of the positive or formlocking fit, the rod 44 is secured against turning relative to the cam 50 and to the bushing 53 and can only be turned about the axis 47 together with the bushing 53 and the cam 50. However, the play of the rod 44 within the recess allows the rod 44 to be displaced relative to the bushing 53 and to the cam 50, along the axis 47. The joint 60 is thus a sliding joint formed by the recess and the rod 44.

A slit diaphragm 48 having a circular recess 49 through which the rod 44 is guided is arranged on the cleaning device 9, offset towards the axis 47 relative to the cam 50 and to the bushing 53. A diagonal distance between corners of the four-sided rod 44, of square cross section, is designed to be less than a diameter of the circular recess 49, so that the rod 44 can be displaced within the recess 49 along the axis 47 and turned about the axis 47. The recess 49 in the diaphragm 48 thus forms, together with the rod 44, a rotating and sliding joint.

A transverse pin 51 is inserted into the rod 44, and has a length exceeding the diameter of the recess 49. The pin 51, which can also be described as a projection, can however be inserted through the slit 52 formed in the diaphragm 48 if the pin 51 is rotated by turning the rod 44 into a position, shown in FIG. 3, wherein it is aligned with the slit 52. With the pin 51 rotated out of alignment with the slit 52, the pin 51 forms a rotary bolt projecting beyond the recess 49 in the radial direction, making contact with the diaphragm 48, and thus preventing an axial displacement of the rod 44 in a first direction.

The recess passing through the cam 50 and the bushing 53 is, by contrast with the recess 49, not widened by a slit through which the pin 51 passes. Thus, in every rotary position of the handle 46 and hence of the rod 44, from a particular sliding position of the rod 44 wherein the pin 51 contacts the cam 50, the pin 51 blocks an axial displacement of the rod 44 in a second direction.

Figure 5:
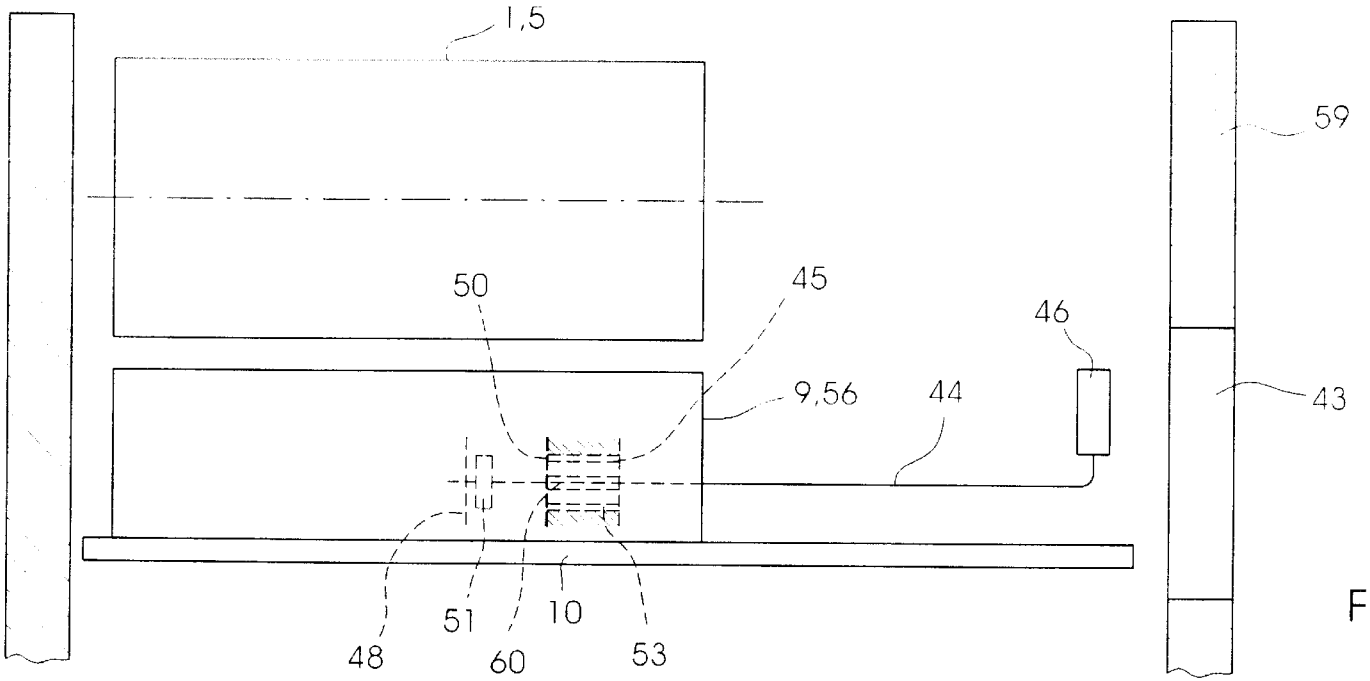
FIG. 5 is a diagrammatic side elevational view of the cleaning device in a condition wherein it is inserted into the printing machine, the rod having been withdrawn from the cleaning device, and the handle having been turned to a rotary position for locking the rod with the cleaning device.

In an alternative arrangement of the cam 50 and the bushing 53, switched relative to one another differently from the arrangement shown in FIGS. 4 and 5, the pin 51 would contact the bushing 53 instead of the cam 50. In the arrangement shown, the cam 50, and in the alternative arrangement, the bushing 53, functions as a further diaphragm which, together with the diaphragm 48 and the pin 51, forms a securing device to lock the rod 44 and hence the handle 46 relative to the cleaning device 9.

With the handle 46 locked (note FIGS. 5 and 6), the pushing or pulling force exerted by the operator on the handle 46 is transmitted, via the pin 51 pressing on the diaphragm 48 or the cam 50, to the cleaning device 9. The securing device (diaphragm 48, cam 50 and pin 51) is similar in structure to a bayonet joint and forms one of the group of socket connectors.

The cam 50 serves not only as a control cam for actuating the setting device 15 but also, in addition, as a bolt of a further securing device, which is rotatable by the handle 46 about the axis 47. This securing device is formed by the cam 50 together with the groove 54 formed in a part fixed on the frame 13 and permits locking of the cleaning device 9 in the operating position thereof. If the cam 50 is moved into the groove 54, the securing device (cam 50, groove 54) blocks a displacement of the cleaning device 9 on the guide 10 in both directions. With the cam 50 located outside the groove 54, the cleaning device 9 is freely displaceable on the guide 10. A crosspiece 55 fixed to the cleaning device 9 and extending with the axis thereof parallel to the rod 44 also serves to actuate the setting device 14.

The interaction of the various devices of the printing machine 1 mentioned hereinbefore is described below.

With the cleaning device 9 removed from the printing machine 1, the handle 46 is placed against a side wall 56 of the cleaning device 9 and the rod 44 is lowered within the device 9, as is shown in FIGS. 3 and 4. The device 9 is thus readily portable. Because the cylinder 5 does not have to be cleaned with the cleaning device 9 continuously, but rather, only intermittently, a printing operation of the printing machine 1, wherein the cylinder 5 is rotatively driven by the motor 21, is also possible with the cleaning device 9 removed from the printing machine 1.

As shown in FIG. 2, with the cleaning device 9 removed from the printing machine 1, the two levers 22 and 24 are held by the springs 28 and 29 in a relative position wherein the arm 22.1 does not press the switch 26 via the ramp 27, so that the switch 26 is in a first switching position wherein the electric circuit 20 is closed.

In order to reinsert the cleaning device 9 into the printing machine 1, for example, after replacing the belt 36 outside the printing machine 1, the cleaning device 9 is fitted onto the guide 10 and pushed along the latter into the printing machine 1. In order to facilitate the insertion, the rod 44 is pulled almost completely out of the cleaning device 9 and the handle 46 is thereby set at a great distance from the wall 56. When the rod 44 is pulled out, the pin 51 passes through the slit 52 into the region between the diaphragm 48 and the cam 50.

Due to subsequent turning of the handle 46 out of the position thereof shown in FIGS. 3 and 4 into the position thereof shown in FIGS. 5 and 6, the handle 46 is locked in the insert direction of the cleaning device 9, relative to the cleaning device 9, by the securing device 48, 50 and 51, so that when the handle 46 is extended by the rod 44, the cleaning device 9 can easily be inserted deeply into the printing machine 1.

In the course of this insertion, the cleaning device 9 strikes the lever 24 and pivots the latter about the joint 25 thereof into a changed angular position relative to the lever 22. In order to facilitate this actuation of the setting device 15 by the cleaning device 9, the crosspiece 55 is arranged so that, during the insertion, the crosspiece 55 contacts the roller 30 and thus presses the arm 24.2 downwardly, out of the insert path of the cleaning device 9, against the restoring action of the spring 28. As a consequence, the switch 26 is moved towards the lever 22 and the ramp 27, presses the latter onto the switch 26 and thus operates it, so that the electric circuit 20 is opened and the motor 21 is deactivated.

The switching device 14 triggered via the setting device 15 by the insertion of the cleaning device 9 is of a construction that, although the printing machine 1 is ready for operation when the cleaning device 9 is located outside the printing machine 1 and the cleaning device 9 is properly locked in the operating position thereof, it is not ready for operation during an intermediate state characterized by the insertion of the cleaning device 9.

When the operator has inserted the cleaning device 9 into the operating position thereof, the cleaning device 9 is locked in the position assumed thereby by turning the handle out of the rotary position thereof shown in FIGS. 5 and 6 into the rotary position thereof shown in FIG. 7. Due to the turning of the handle 46, a further actuation of the switching device 14 via the setting device 15 takes place simultaneously with the locking, the cam 50, pivoting about the axis 47, pressing the lever 22 out of the previous angular position thereof relative to the lever 24 into another angular position. The actuation of the switching device 14 by the cam 50 via the setting device 15 takes place gently, as the cam 50 presses the lever arm 22.2 downwardly via the roller 31. The displacement of the lever 22 caused by the rotary movement of the cam 50 effects a diminishing pressure of the arm 22.1 on the switch 26 via the ramp 27, due to which the switch 26 is switched back into the first switching position thereof, wherein the electric circuit 20 is closed, the motor 21 can be supplied with current via the electric circuit 20, and the printing machine 1 is thus ready for operation.

Simultaneously with the switching of the switching device 14, the pivoting of the lever 22 about the joint 23, driven via the handle 46, the rod 44 and the cam 50, causes a displacement of the setting devices 16 and 18 and, as a consequence of this displacement, a movement of the monitoring devices 17 and 19 out of the retracted positions thereof shown in FIG. 2 into the advanced positions thereof shown in FIG. 7.

To secure the rotary position of the handle 46 which locks the cleaning device 9 to the printing machine 1, a locking device 57 is provided having a locking part formed by the roller 31 and having a locking part seat formed by a concave notch 58 in the otherwise convexly curved cam curvature of the cam 50. As shown in FIG. 7, the roller 31, with the locking device 57 locked, is located in the notch 58. The locking part (roller 31) is retained in the locking part seat (notch 58) by the spring 29 until such time as the limiting force of the locking device 57 determined by the springs 29 is overcome by turning the handle 46, and the roller 31 is pressed out from the notch 58 against the action of the spring 29, the locking device 57 thus being unlocked.

A particularly advantageous feature of the printing machine 1 is that the cleaning device 9 can be inserted deeply into the printing machine 1 and, with the cleaning device 9, inserted into the operating position thereof (note FIG. 5), a space between the wall 56 of the cleaning device 9 and a machine wall 59 wherein the window 43 is located is bridged by the rod 44. This space, bridged by the rod 44 and also by the guide 10, is almost as long as the length of the cylinder 5 and the length of the cleaning device 9. Furthermore, the operationally reliable one-handed operation is advantageous. For the devices 14 to 19 and for inserting the cleaning device 9, only a single operating element in the form of the handle 46 is necessary, it being necessary only for the operator to turn the handle 46 after inserting the cleaning device 9 into the printing machine 1, virtually without releasing it, in order to actuate the devices 14 to 19.

The actuations of the devices 14 to 19 when the cleaning device 9 is removed from the printing machine 1 take place in a sequence opposite to that for the insertion of the cleaning device 9. First, the securing device 50, 54 is released from the securing condition thereof, the monitoring devices 17 and 19 simultaneously being pivoted back and the switching device 14 being actuated, as a result of which the motor 21 is deactivated. When the cleaning device 9 is retracted or withdrawn from the printing machine 1, the cleaning device 9 comes out of contact with the lever 24, as a result of which, the latter switches the switching device 14 back, so that the printing machine 1 is again ready for operation. If the cleaning device 9 is withdrawn far enough from the window 43 during the removal thereof from the printing machine 1, so that the operator can easily grip the cleaning device 9, the securing device 50, 54 can be released from the securing condition thereof, the rod 44 inserted into the cleaning device 9, and the handle 46 placed against the cleaning device 9.

We claim:

1. In a printing machine, a cleaning device assembly for the printing machine, comprising:

a rectilinear guide;

a cleaning device having a handle for moving said cleaning device along said rectilinear guide; and at least one joint, said handle being attached to said cleaning device by said at least one joint such that said handle is movable relative to said cleaning device.

2. The cleaning device assembly according to claim 1, including a rod mounted in said at least one joint, said handle being disposed on said rod.

3. The cleaning device assembly according to claim 1, wherein said joint is a pivot.

4. The cleaning device assembly according to claim 1, wherein said joint is a sliding joint.

5. The cleaning device assembly according to claim 1, including at least one securing device having said handle as an operating element.

6. The cleaning device assembly according to claim 5, wherein said at least one securing device is constructed for securing said handle in a predetermined position and said handle is adjustable relative to said cleaning device into said predetermined position.

7. The cleaning device assembly according to claim 5, wherein said at least one securing device is constructed for securing said cleaning device in a predetermined position and said cleaning device is adjustable relative to the printing machine into said predetermined position.

8. The cleaning device assembly according to claim 1, including at least one setting device having said handle as an operating element.

9. The cleaning device assembly according to claim 8, including an electrical switching device, said at least one setting device being constructed for switching said electrical switching device.

10. The cleaning device assembly according to claim 8, including at least one monitoring device, wherein said at least one setting device being constructed so as to displace the at least one monitoring device.

11. In a printing machine, a cleaning device assembly for the printing machine, comprising:

a rectilinear guide;

a cleaning device having a handle for moving said cleaning device along said rectilinear guide; and at least one sliding joint, said handle being attached to said cleaning device by said at least one sliding joint for moving said handle relative to said cleaning device.

12. In a printing machine, a cleaning device assembly for the printing machine, comprising:

a rectilinear guide;

a cleaning device having a handle for moving said cleaning device along said rectilinear guide; and at least one single rotating and sliding joint, said handle being attached to said cleaning device by said at least one single rotating and sliding joint for moving said handle relative to said cleaning device.

* * * * *